US005524569A

United States Patent [19]

Rich et al.

[11] Patent Number: 5,524,569

[45] Date of Patent: Jun. 11, 1996

[54] ANCHOR COVER

[76] Inventors: William A. Rich, 4 Alma La.; Arthur I. Singer, 26 Gilbert La., both of Plainview, N.Y. 11803

[21] Appl. No.: 406,735

[22] Filed: Mar. 20, 1995

[51] Int. Cl.[6] ..... B63B 21/24

[52] U.S. Cl. ..... 114/294; 114/218

[58] Field of Search ..... 114/293, 294, 114/300–309, 310, 210, 221 R, 218; 150/154

[56] References Cited

U.S. PATENT DOCUMENTS

| | | | |
|---|---|---|---|
| 3,106,181 | 10/1963 | Dare | 114/210 |
| 3,274,969 | 9/1966 | Baas | 114/309 |
| 3,368,513 | 2/1968 | Dove | 114/210 |
| 3,620,309 | 11/1971 | Erickson | 150/154 |
| 3,704,738 | 12/1972 | LeCompte | 150/154 |
| 4,004,625 | 1/1977 | Zietlow, Jr. | 114/294 |
| 4,374,534 | 2/1983 | Jespers et al. | 150/154 |
| 4,685,500 | 8/1987 | Silvia | 114/218 |
| 5,095,842 | 3/1992 | Soules | 114/210 |
| 5,327,844 | 7/1994 | Kress | 114/218 |

*Primary Examiner* Edwin L. Swinehart

[57] ABSTRACT

The invention provides an anchor cover for encasing or covering the stock and enlarged top portion of an anchor. This device is for use specifically when an anchor is mounted at the bow of a boat, in order to prevent the anchor from causing damage to other nearby boats and objects when the boat upon which the anchor is mounted is attempting to enter or exit a boat docking area. The anchor cover can be formed of only one piece that is fitted to encase both ends of the stock as well as the enlarged top portion within its hollow body cavity. The anchor cover can also be formed of three separate pieces, two stock-enclosing portions and one top-enclosing portion, for encasing those parts of the anchor.

7 Claims, 2 Drawing Sheets

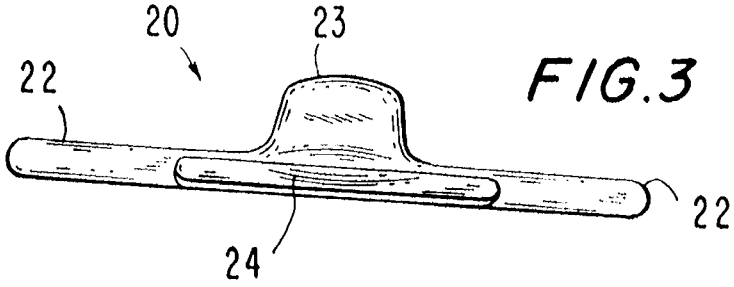
FIG. 3
FIG. 4
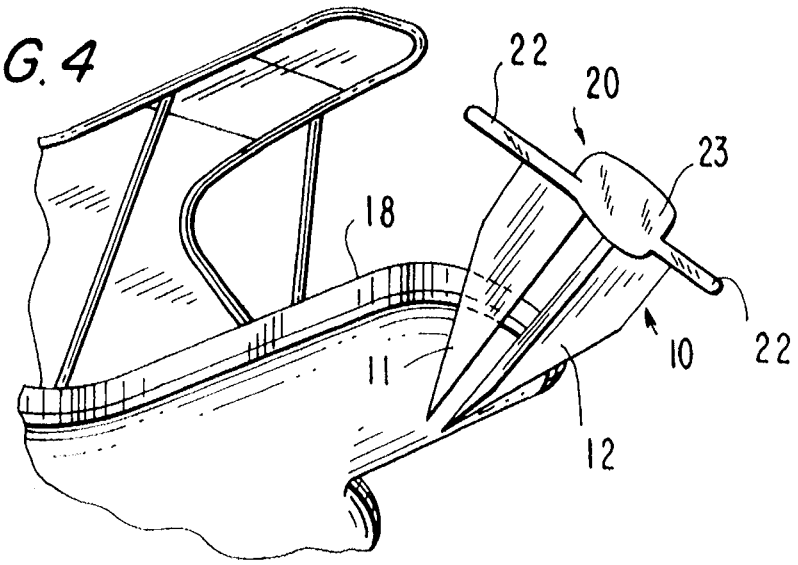
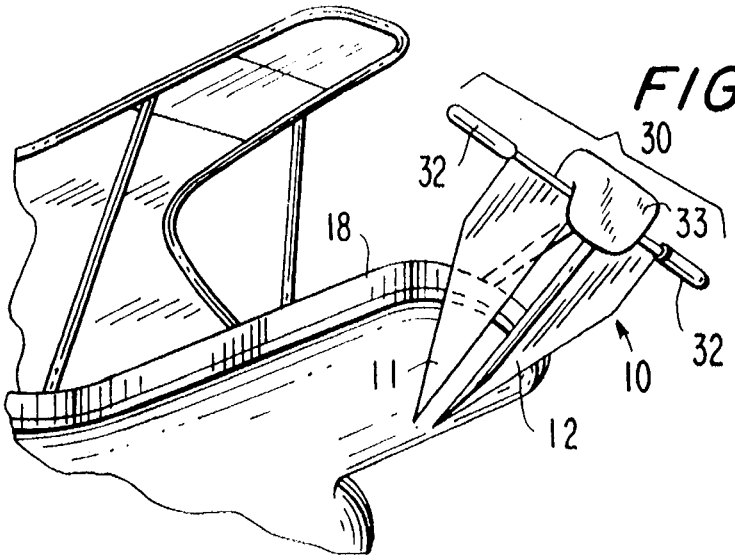
FIG. 5

ANCHOR COVER

BACKGROUND OF THE INVENTION

This invention relates to the field of marine equipment and, more particularly, to the field of devices for securely covering anchors when they are not in their intended use.

For many years, the method of use of anchors was by dropping the anchor over the side of a boat or ship each time it was desired for the craft to anchor and then having to raise the anchor into the craft each time it was desired for the craft to set sail. Under this method, however, considerable damage was done to the outside of the boat by the anchor on its way up from the water into the boat or on its way down from the boat into the water. In addition, the sheer weight and irregular size and shape of the anchor often damaged the deck of the boat when being moved to or from the edge or when being lifted or set down.

Because of the difficulty involved in raising and lowering anchors, another method was developed whereby, when not in use, the anchor is suspended from the front or bow of the boat in a bracket or another holder and is then lowered into the water by a pulley. The anchor is later lifted by the pulley into the bracket. This method, too, was found to damage boats, because any rocking movement of the boat caused the anchor to be swung against the boat or against the side of other boats nearby. Thus, various devices had been invented to remedy the problem, for example, by providing anchor holders to prevent the anchor from swinging from its suspended position and causing damage. See, for example, U.S. Pat. Nos. 1,109,052 (Edman et al.), 2,203,390 (Maxwell) and 3,068,828 (Ellis).

Nowadays, the more common position for an anchor on a boat is above-deck at the bow of the boat and affixed to the boat or held there by a bracket so that the anchor can be placed there easily from the deck and so that the anchor does not sway or swing when the boat rocks from side to side. However, because of the usual shape and size of anchors, another problem is created. As shown in FIG. 1, a typical anchor 10 is formed from steel and has two large downward extending blades 11,12, called flukes, attached to an elongated horizontal bar 13, called a stock. A vertical bar 14, called a shank, that is about twice the length of the stock 13 is attached perpendicularly to the stock 13 between the flukes 11,12 and extends downward form the stock 13 at an acute angle relative to the flukes 11,12. An clarged top portion 15 is also provided about the point of attachment of the shank 14 to the stock 13 but extending in a direction opposite to the flukes 11,12, in order to provide better balance and penetrability for the anchor 10. FIG. 2 shows this typical anchor 10 mounted on and projecting from the bow of a boat 18. When a boat having this typical anchor mounted to its bow attempts to dock or back away from a dock and does not do so absolutely perfectly, the bow of the boat will approach or contact the sides of other, nearby boats, and the stock 13 and the enlarged top portion 15 of the anchor 10, which both project outward from the bow of the boat, will often cause scrapes and other damage to nearby boats. This situation is exacerbated by the ever-decreasing docking space allotted per boat as the number of boats requiring docking space increases. The narrow docking space almost guarantees that the bow region of a boat moving in or out of the dock will contact a nearby boat. Due to the anchors affixed to the front of the boats, this contact will undoubtedly have some damaging effect.

SUMMARY OF THE INVENTION

It is, therefore, an object of this invention to provide a new and improved device for preventing an anchor from damaging nearby boats.

It is a further object of this invention to provide such a device for guarding the anchor against direct contact between the anchor and nearby boats.

It is a further object of this invention to provide such a device for softening the impact between the anchor and any nearby boats.

These and other objects are accomplished in accordance with the principles of the invention by providing an anchor cover for encasing or covering the stock and enlarged top portion of an anchor. This device is for use specifically when an anchor is mounted at the bow of a boat, in order to prevent the anchor from causing damage to other nearby boats and objects when the boat upon which the anchor is mounted is attempting to enter or exit a boat docking area. The anchor cover can be formed of only one piece that is fitted to encase both ends of the stock as well as the enlarged top portion within its hollow body cavity. The anchor cover can also be formed of three separate pieces, two stock-enclosing portions and one top-enclosing portion, for encasing those parts of the anchor.

BRIEF DESCRIPTION OF THE DRAWINGS

The above and other objects and advantages of the present invention will be apparent upon consideration of the following detailed description, taken in conjunction with the accompanying drawings, in which the characters refer to like parts throughout, and in which:

FIG. 3 shows a first embodiment of an anchor cover of the present invention;

FIG. 4 shows a bottom perspective view of a first embodiment of an anchor cover of the present invention in use with a traditional achor as generally mounted at the bow of a boat or other sea vessel; and FIG. 5 shows a bottom perspective view of a second embodiment of an anchor cover of the present invention in use with a traditional achor as generally mounted at the bow of a boat or other sea vessel.

DETAILED DESCRIPTION OF THE INVENTION

Figure 1:
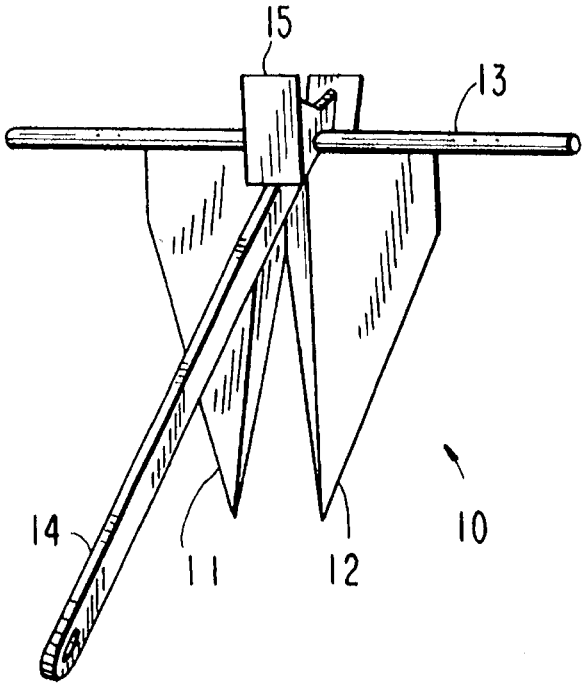
FIG. 1 PRIOR ART
FIG. 1 is a perspective view of a traditional anchor with which the present invention is used.
Figure 2:
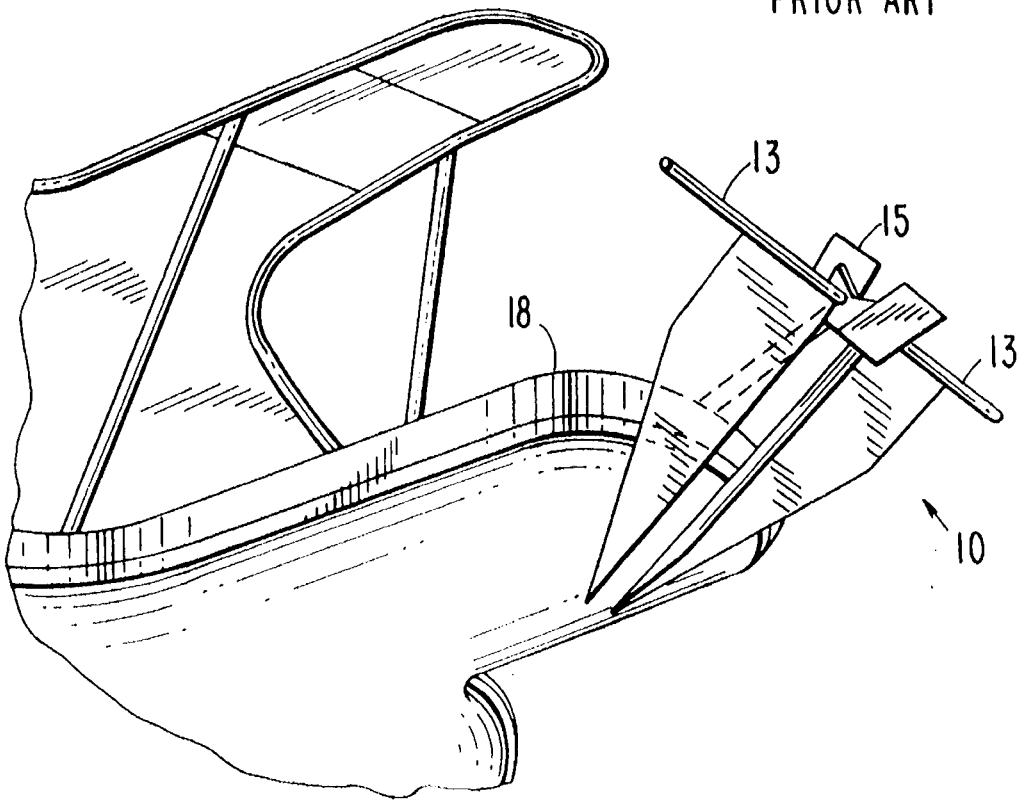
FIG. 2 PRIOR ART
FIG. 2 is a bottom perspective view of the traditional anchor of FIG. 1 as generally mounted at the bow of a boat or other sea vessel.

In accordance with the principles of the present invention, an anchor cover is provided for protecting nearby boats from damage caused by an anchor mounted on and projecting from the bow of a boat that is attempting to enter or exit from a docking area. FIG. 1 shows a prior art traditional anchor 10 and FIG. 2 shows the traditional anchor 10 as generally mounted on the bow of a boat 18.

As illustrated in FIG. 3, in a preferred embodiment of this invention, the anchor cover, generally designated 20, comprises a hollow body portion 21 for encasing the entire stock 13 and enlarged top portion 15 of the anchor 10. The anchor cover 20 further comprises two stock-enclosing portions 22 for encasing both ends of the stock 13 and a top-enclosing portion 23 for encasing the enlarged top portion 15 of the anchor 10. The anchor cover of the preferred embodiment as used on a traditional anchor 10 and mounted at the bow of a boat 18 is illustrated in FIG. 4. The anchor cover 20 is preferably comprised of one piece having a central opening 24 for insertion therein of the top region, including the stock 13 and the enlarged top portion 15, of the anchor 10.

Preferably, therefore, the anchor cover 20 should be formed of an elasticized or otherwise stretchable material in order to fit snugly over the anchor portions without falling off and without requiring additional means for securing it onto the anchor 10. The anchor cover 20 can be formed from rubber, plastic or some other material that will allow the anchor cover 20 to be stretched over the stock 13 and enlarged top anchor portion 15 and, after covering them as shown in FIG. 4, prevent them from causing damage when coming in contact with other surfaces or vessels.

An alternative embodiment of this invention is shown in FIG. 5 in use on a traditional anchor 10 mounted at the bow of a boat 18. In this embodiment, the anchor cover, generally designated 30, comprises three separate portions: two stock-enclosing portions 32 and one top-enclosing portion 33. The top-enclosing portion 33 comprises a hollow body portion for encasing only the enlarged top portion 15 of the anchor 10, and is preferably formed from one piece having a central opening (not shown) for insertion therein of the enlarged top region 15 of the anchor 10. Each of the two stock-enclosing portions 32 comprises a hollow body portion for encasing only one end of the stock 13, and is preferably formed from one piece having a central opening (not shown) for insertion therein of an end of the stock 13.

Naturally, the anchor cover of the present invention may also be practices on anchors of either smaller or larger size and on anchors of different shape than that described herein.

Thus, an anchor cover is provided. One skilled in the art will appreciate that the present invention can be practiced by other than the described embodiments, which are provided for purposes of illustration and not limitation, and that the present invention is limited only by the claims that follow.

We claim:

1. An anchor cover for protecting nearby sea vessels from damage due to contact between the sea vessels and an anchor that is mounted on a boat, said anchor having an elongated stock, an elongated shank extending generally perpendicularly from a central portion of the stock, an enlarged central region projecting from the stock in a direction opposite to the shank, and two flukes extending from the stock on either side of the shank and at an acute angle thereto, said anchor cover comprising a hollow body portion having two outwardly-extending portions and a central cover portion, wherein each of said two outwardly-extending portions is fit over an opposed end of the stock of an anchor and the central cover portion is fit over the enlarged central region of an anchor.

2. The anchor cover of claim 1 wherein said anchor cover is formed from one unitary section.

3. The anchor cover of claim 2 wherein said anchor cover further comprises a central opening in said hollow body portion through which the stock and the enlarged central region of the anchor are inserted, such that each end of the stock is encased by one of said two outwardly-extending portions and such that the enlarged central region of the anchor is encased by said central cover portion.

4. The anchor cover of claim 3 wherein said anchor cover is formed from a rubberized or plasticized material.

5. The anchor cover of claim 1 wherein said anchor cover is formed from three sections, two shank-end covering portions and one central cover portion.

6. The anchor cover of claim 5 wherein said anchor cover further comprises a central opening in said central cover portion through which the enlarged central region of the anchor is inserted, such that the enlarged central region of the anchor is encased by said central cover portion.

7. The anchor cover of claim 5 wherein said anchor cover is formed from a rubberized or plasticized material.

* * * * *